US011134742B2

(12) United States Patent
Ferrari et al.

(10) Patent No.: US 11,134,742 B2
(45) Date of Patent: Oct. 5, 2021

(54) AMBIDEXTROUS FACE GUARD

(71) Applicant: Dick's Sporting Goods, Inc., Coraopolis, PA (US)

(72) Inventors: Lucas Ferrari, Clinton, PA (US); Charles P. Larson, Coraopolis, PA (US); Chinawut Paesang, Sewickley, PA (US)

(73) Assignee: Dick's Sporting Goods, Inc., Coraopolis, PA (US)

( * ) Notice: Subject to any disclaimer, the term of this patent is extended or adjusted under 35 U.S.C. 154(b) by 90 days.

(21) Appl. No.: 16/357,463

(22) Filed: Mar. 19, 2019

(65) Prior Publication Data

US 2020/0297061 A1 Sep. 24, 2020

(51) Int. Cl.
*A42B 3/32* (2006.01)
*A63B 71/10* (2006.01)
*A42B 3/20* (2006.01)

(52) U.S. Cl.
CPC ..... *A42B 3/326* (2013.01); *A42B 3/205* (2013.01); *A63B 71/10* (2013.01)

(58) Field of Classification Search
CPC ..... A42B 3/326; A42B 3/0406; A42B 3/205; A42B 3/16; A42B 3/18; A42B 3/20; A63B 71/10
USPC ..... 2/423, 424, 425
See application file for complete search history.

(56) References Cited

U.S. PATENT DOCUMENTS

D167,089 S 6/1952 Leight
2,861,270 A * 11/1958 McCoy ..... A42B 1/08 2/423
3,067,427 A * 12/1962 McClintock, Sr. ..... A61F 9/045 2/9
3,886,596 A * 6/1975 Franklin ..... A42B 3/20 2/9
D285,981 S 10/1986 Ekins
4,677,694 A 7/1987 Crow
4,885,806 A * 12/1989 Heller ..... A42B 3/20 2/423
D309,512 S * 7/1990 Crow ..... F41H 1/04 D29/105
5,263,204 A 11/1993 Butsch
(Continued)

OTHER PUBLICATIONS

"BaseballSavings.com." BaseballSavings.com, Oct. 6, 2016, www.baseballsavings.com/champro-youth-hx-gamer-plus-batting-helmet-w-universal-jaw-guard. (Year: 2016).*
(Continued)

*Primary Examiner* — Sally Haden
(74) *Attorney, Agent, or Firm* — Fox Rothschild LLP

(57) ABSTRACT

An ambidextrous face guard includes an attachment portion having at least two attachment points. The attachment portion extends from a first end of the ambidextrous face guard toward a second end of the ambidextrous face guard along a slope. The ambidextrous face guard includes a protective portion extending from the attachment portion toward the second end of the ambidextrous face guard along the slope. A line of symmetry extends along at least the attachment portion from the first end of the ambidextrous face guard toward the second end of the ambidextrous face guard such that the line of symmetry defines two symmetric portions of the ambidextrous face guard that each extend along at least a portion of a length of the ambidextrous face guard. The ambidextrous face guard is configured to attach to a right side and a left side of a headgear via the attachment points.

11 Claims, 9 Drawing Sheets

(56) References Cited

U.S. PATENT DOCUMENTS

| | | | | |
|---|---|---|---|---|
| D511,225 | S | 11/2005 | Brown et al. | |
| D514,259 | S | 1/2006 | Brown et al. | |
| 7,797,764 | B2 | 9/2010 | Norris | |
| 8,490,214 | B2 * | 7/2013 | Crye | F41H 1/04 2/2.5 |
| D769,540 | S | 10/2016 | Meier | |
| D769,541 | S | 10/2016 | Meier | |
| 9,511,272 | B2 | 12/2016 | Lowe et al. | |
| 9,566,497 | B2 | 2/2017 | Erb et al. | |
| D829,999 | S | 10/2018 | Slump et al. | |
| 10,258,098 | B2 * | 4/2019 | Erb | A42B 3/20 |
| D853,659 | S | 7/2019 | Schmidt et al. | |
| 2004/0214147 | A1 | 10/2004 | Robinson | |
| 2008/0000016 | A1 * | 1/2008 | Kellogg | A42B 3/0406 2/410 |
| 2008/0092279 | A1 | 4/2008 | Chiang | |
| 2009/0126062 | A1 * | 5/2009 | Bengochea | A42B 3/0406 2/10 |
| 2014/0033407 | A1 * | 2/2014 | Renaud | A42B 3/04 2/422 |
| 2016/0270473 | A1 * | 9/2016 | Warmouth | A42B 3/127 |
| 2017/0245574 | A1 * | 8/2017 | Danko | A42B 1/064 |
| 2019/0037957 | A1 * | 2/2019 | Schmidt | A42B 3/20 |
| 2020/0061890 | A1 | 2/2020 | Rusakov et al. | |
| 2020/0085130 | A1 | 3/2020 | Beckman | |
| 2020/0146386 | A1 | 5/2020 | Schmidt et al. | |
| 2020/0268089 | A1 | 8/2020 | Townson et al. | |

OTHER PUBLICATIONS

Google Search, Google, www.google.conn/search?q=champro%2Buniversal%2Bjaw%2Bguard&rlz=1C1GCEB_enUS802US802&sxsrf=ACYBGNTCo1WwGpYwiE2J081uXIEf5LHL6Q%3A1573068056848&source=Int&tbs=cdr%3A1%2Ccd_min%3A%2Ccd_max%3A3%2F18%2F2019&tbm=. (Year: 2019).*

"Champro HX Performance Batting Helmet," published Jan. 7, 2019, accessed Jan. 31, 2020, https://web.archive.org/web/20190107042606/http://shop.champrosports.com:80/c-1019-batting-helmets.aspx (Year: 2016).*

SST Face Guard z5jr-1, SST Baseball webpage, downloaded Mar. 18, 2019, <https://www.sstbaseball.com/sst-face-guard-z5jr-1/>.

Mach Ext Batting Helmet Extension for Left-Handed Batter, Rawlings webpage, downloaded Mar. 15, 2019, <https://www.rawlings.com/product/MEXTL.html>.

Adidas Senior Captain Batting Helmet w/Jaw Guard (on-line), no date available. Retrieved from Internet Sep. 11, 2020, URL: https://www.dickssportinggoods.com/p/adidas-senior-captain-batting-helmet-w-jaw-guard-19adiucptnsrjwgrdbth/19adiucptnsjwgrdbth (1 page).

3 Baseball Helmet Face Guards—Bat Digest (on-line), dated Mar. 20, 2019. Retrieved from Internet Sep. 11, 2020, URS: https://www.justbatreviews.com/ball-gear/baseball-helmet-face-guard/ (1 page) (Year: 2019).

Baseball Batting Helmet Face Guard—Boombah (on-line), dated Dec. 8, 2017. Retrieved from Internet Sep. 11, 2020, URL: https://web.archive.org/web/20171208092425/https://www.boombah/com/US/sports/baseball-batting-helmet-face-guards.html (2 pages) (Year: 2017).

Pro X Matte W Extended Jaw Guard Batting Helmet—Easton (on-line), no date available. Retrieved from Internet Sep. 11, 2020, URL: https://www.easton.com/baseball-equipment/baseball-helmets/pro-x-matte-w-extended-jaw-guard-PROXJAW.html (1 page).

* cited by examiner

AMBIDEXTROUS FACE GUARD

BACKGROUND

The present disclosure generally relates to ambidextrous face guards for headgear.

To protect a batter's cheek, jaw, and/or face while batting, the batter may install a face guard on a side of the batter's helmet facing the pitcher. However, conventional face guards are designed for either left-handed batters or right-handed batters. That is, these conventional face guards are limited to connecting to only one side of a helmet. For example, a left side face guard can only attach to the left side of the helmet, and a right side face guard can only attach to the right side of the helmet.

SUMMARY

In an embodiment, an ambidextrous face guard includes an attachment portion having at least two attachment points. The attachment portion extends from a first end of the ambidextrous face guard toward a second end of the ambidextrous face guard along a slope. The ambidextrous face guard includes a protective portion extending from the attachment portion toward the second end of the ambidextrous face guard along the slope. The protective portion is a semi-flexible or flexible structure. A line of symmetry extends along at least the attachment portion from the first end of the ambidextrous face guard toward the second end of the ambidextrous face guard such that the line of symmetry defines two symmetric portions of the ambidextrous face guard that each extend along at least a portion of a length of the ambidextrous face guard. The ambidextrous face guard is configured to attach to a right side and a left side of a headgear via one or more of the attachment points.

The attachment portion may be a U-shaped structure in which the at least two attachment points are arranged on the U-shaped structure.

The ambidextrous face guard may optionally include a cover plate. The attachment portion may include a recessed area, and the cover plate may be configured to be received within the recessed area. The recessed area may include one or more post receivers positioned within the attachment portion. The cover plate may include one or more posts protruding from a bottom surface of the cover plate. A post of the one or more posts may be configured to fit within a respective post receiver of the one or more post receivers.

Optionally, the second end of the ambidextrous face guard may be curved along a convex angle.

A first symmetrical half of the protective portion may slope downwards from a middle portion of the protective portion to a first side edge of the protective portion and from a top edge of the protective portion to a bottom edge of the protective portion. A second symmetrical half of the protective portion may slope downwards from the middle portion to a second side edge of the protective portion and from the top edge to the bottom edge.

The ambidextrous face guard may be configured to cover at least a portion of a face of a user, when attached to the headgear and the headgear is worn by the user. The protective portion may be configured to absorb an impact from an object. The line of symmetry may be a curved line of symmetry, and the slope may be curved.

One or more of the attachment points may include one or more through holes. Each through hole may be configured to receive a fastener. Each fastener may be configured to fasten the guard to one or more connection points of the headgear.

Optionally, the ambidextrous face guard may include a first attachment point, a second attachment point, a third attachment point, and a fourth attachment point. The first attachment point and the second attachment point may be located in proximity to a first end of the attachment portion. The third attachment point and the fourth attachment point may be located in proximity to a second end of the attachment portion. The first attachment point, the second attachment point and the third attachment point may be configured to align with connection points on the left side the headgear. The first attachment point, the second attachment point and the fourth attachment point may be configured to align with connection points on the right side of the headgear.

Optionally, the protective portion further may include a trapezoidal portion positioned near a distal end of the ambidextrous face guard. An outer surface of the trapezoidal portion may slopes inward toward the headgear when the ambidextrous face guard is connected to the headgear.

In an embodiment, a protection system may include a headgear and an ambidextrous face guard. The ambidextrous face guard includes an attachment portion having at least two attachment points. The attachment portion extends from a first end of the ambidextrous face guard toward a second end of the ambidextrous face guard along a slope. The ambidextrous face guard includes a protective portion extending from the attachment portion toward the second end of the ambidextrous face guard along the slope. The protective portion is a semi-flexible or flexible structure. A line of symmetry extends from the first end of the ambidextrous face guard toward the second end of the ambidextrous face guard, and along at least the attachment portion such that the line of symmetry defines two symmetric portions of the ambidextrous face guard that each extend along at least a portion of a length of the ambidextrous face guard. The ambidextrous face guard is configured to attach to a right side and a left side of the headgear via one or more of the attachment points.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description.

DETAILED DESCRIPTION

Figure 1A:
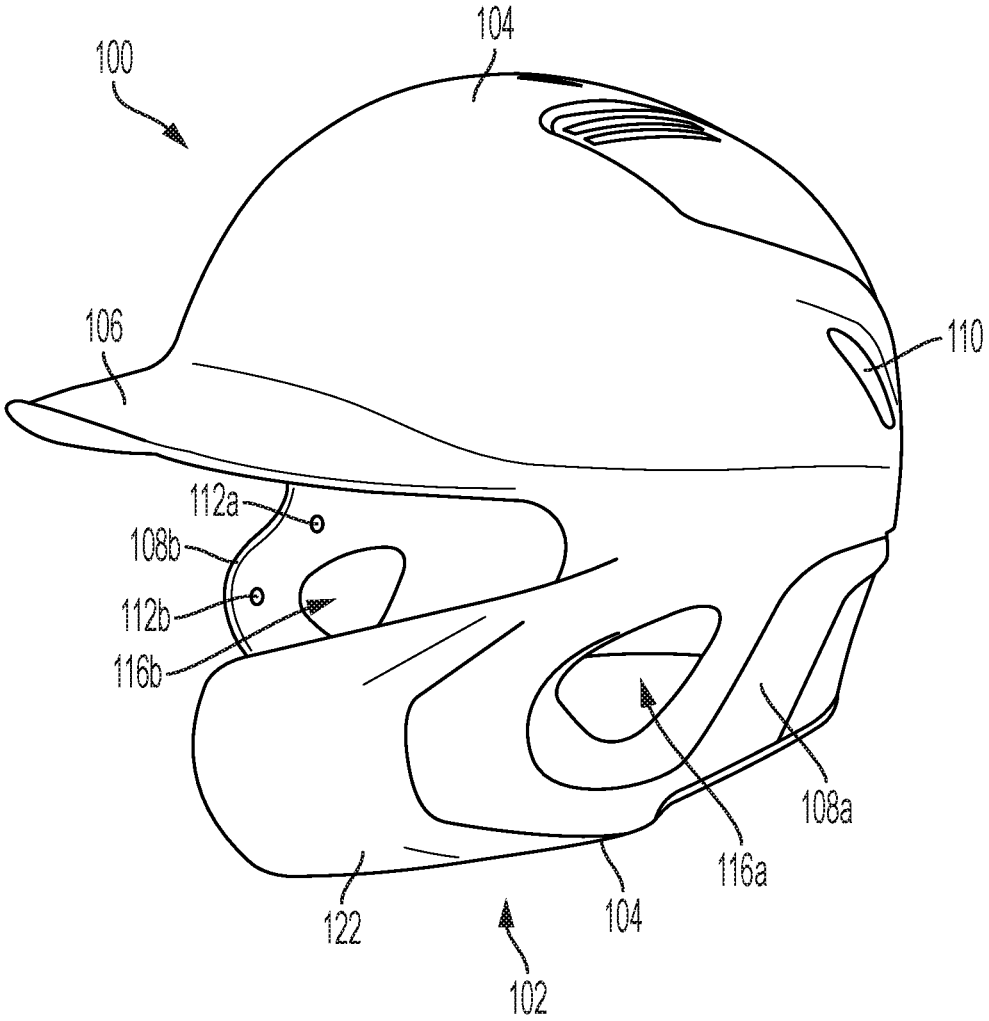
FIG. 1A illustrates an isometric view of an example headgear having an ambidextrous guard.

The following discussion omits or only briefly describes conventional features of headgear, which are apparent to those skilled in the art. It is noted that various embodiments are described in detail with reference to the drawings, in which like reference numerals represent like parts and assemblies throughout the several views. Reference to various embodiments does not limit the scope of the claims attached hereto. Additionally, any examples set forth in this specification are intended to be non-limiting and merely set forth some of the many possible embodiments for the appended claims. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc. It must also be noted that, as used in the specification and the appended claims, the singular forms "a," "an" and "the" include plural referents unless otherwise specified, and that the terms "comprises" and/or "comprising," when used in this specification, specify the presence of stated features, elements, and/or components, but do not preclude the presence or addition of one or more other features, steps, operations, elements, components, and/or groups thereof.

Embodiments of the present disclosure relate generally to an ambidextrous face guard for a headgear. A headgear refers to an element which may be worn on the head. Examples of headgear include, without limitation, helmets, hats, caps, hard hats and/or the like. Although the present disclosure discusses the use of an ambidextrous face guard with a helmet, it is understood that additional and/or alternate types of headgear may be used within the scope of this disclosure Embodiments of an ambidextrous face guard are described below with reference to FIGS. 1-9B.

FIG. 1A illustrates an isometric view of a headgear 100 having an ambidextrous guard 102 (hereinafter "guard 102"), according to one or more embodiments.

The headgear 100 may be a protective headgear. For example, the headgear 100 may be a softball helmet, baseball helmet, cricket helmet, hockey helmet, and/or the like. The headgear 100 includes a dome-shaped shell 104 configured to fit over a wearer's head. The shell 104 may be sized for a particular wearer such that the shell 104 is slightly larger than the wearer's head and includes padding on one or more portions of the inner walls inside of the headgear 100. The padding may be used to absorb an object, such as a baseball or softball, impacting the outer surface of the headgear 100. The padding may be large enough to contact and fit snugly on the wearer's head.

The headgear 100 may also include a brim (such as, for example, a bill or visor) 106, one or more air vents 110, a left ear cover 108*a*, and a right ear cover 108*b*. The brim 106 is formed on a frontal portion of the headgear 100, and is configured to rest over the wearer's forehead. The brim 106 may also be used to shade the wearer's eyes from sunlight. The one or more air vents 110 may include one or more holes positioned in the shell 104 of the headgear 100, and may be configured to ventilate the headgear 100 and cool the wearer's head.

The left side of the headgear 100 extends downward to form a left ear cover 108*a* configured to protect a wearer's ear. The left ear cover 108*a* may be formed in a rounded shape or a shape ergonomic to a wearer's ear. The left ear cover 108*a* may include a left ear hole 116*a*. The left ear hole 116*a* is a cutout of the left ear cover 108*a* and is positioned over the wearer's ear when the headgear 100 is fitted on the wearer's head. The cutout of the left ear hole 116*a* may be formed in a variety of shapes, such as a circular shape, a semi-triangular shape, a square shape and/or the like. Padding may be included on the inner surface of the left ear cover 108*a*.

The right side of the headgear 100 extends downward to form a right ear cover 108*b* configured to protect a wearer's ear. The right ear cover 108*b* may be formed in a rounded shape or a shape ergonomic to a wearer's ear. The right ear cover 108*b* may include a right ear hole 116*b*. The right ear hole 116*b* is a cutout of the right ear cover 108*b* and is positioned over the wearer's ear when the headgear 100 is fitted on the wearer's head. The cutout of the right ear hole 116*b* may be formed in a variety of shapes, such as a circular shape, a semi-triangular shape, a square shape and/or the like. Padding may be included on the inner surface of the right ear cover 108*b*.

Figure 1B:
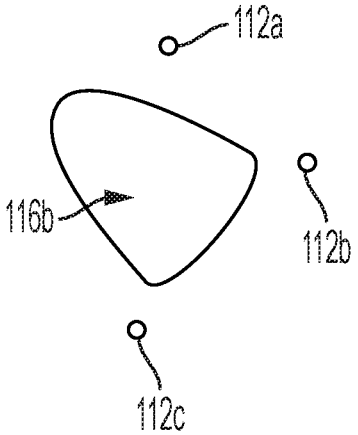
FIGS. 1B and 1C illustrate example placements of various connection points.
Figure 1C:
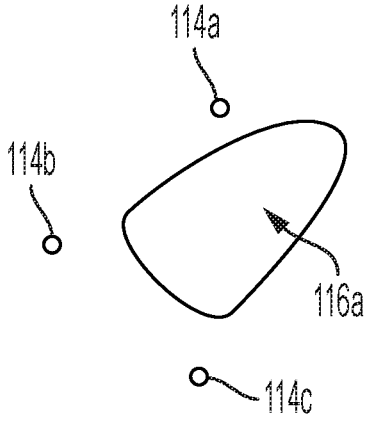

The left ear cover 108*a* and the right ear cover 108*b* each include at least two connection points. For example, as illustrated in FIG. 1C, the left ear cover 108*a* may include a first connection point 114*a* and a second connection point 114*b*. In another example, the left ear cover 108*a* may include three connection points, such as the first connection point 114*a*, the second connection point 114*b*, and a third connection point 114*c*. In another example, as illustrated in FIG. 1B, the right ear cover 108*b* may include a first connection point 112*a* and a second connection point 112*b*. In yet another example, the right ear cover 108*b* may include three connection points, such as the first connection point 112*a*, the second connection point 112*b*, and a third connection point 112*c*.

In an embodiment, a connection point may be through hole that extends through a portion of a headgear 100. For example, a connection point may be a through hole configured to receive a fastener to secure a guard 102 to a respective ear cover. In one or more other cases, the inner walls of the connection points may be threaded in order to receive a threaded portion of the fastener to secure the guard 102 to the respective ear cover. The guard 102 may be configured to attach to either the right or left side of the headgear 100. To attach the guard 102 to the headgear 100, the guard 102 may be fastened to the outer surface of either the right ear cover 108*b* or the left ear cover 108*a*, via at least two connection points. A protection system can be formed when the guard 102 is attached to the headgear 100.

In another embodiment, a connection point may be a bracket that is attached to a portion of a headgear 100. A guard 102 may include a corresponding clip, bracket, buckle and/or other mechanism that may be configured to attach to the bracket of the headgear 100. Additional and/or alternate connection points may be used within the scope of this disclosure.

At least two connection points on the right ear cover 108*b* may be positioned to align with at least two fastener holes and/or adjustable fastener holes of the guard 102. At least two connection points on the left ear cover 108*a* may be positioned to align with at least two fastener holes and/or adjustable fastener holes of the guard 102. The connection points on the right ear cover 108*b* may be positioned to mirror the connection points on the left ear cover 108*a*.

The connection points may be adjacently disposed around a respective ear hole. For example, when viewed from an outer right side view of the headgear 100, the first connection point 112*a* may be located in an area at least partially north of the right ear hole 116*b*; the second connection point 112*b* may be located in an area at least partially east of the right ear hole 116*b*; and the third connection point 112*c* may be located in an area at least partially south of the right ear hole 116*b*. In another example, when viewed from an outer left side view of the headgear 100, the first connection point 114*a* may be located in an area at least partially north of the left ear hole 116*a*; the second connection point 114*b* may be located in an area at least partially east of the left ear hole 116*a*; and the third connection point 114*c* may be located in an area at least partially south of the left ear hole 116*b*. For the cases in which an ear cover includes three connection points, the connection points may be arranged in a triangular pattern. It is understood that additional connection points and/or different placement of connection points may be used within the scope of this disclosure.

Figure 2A:
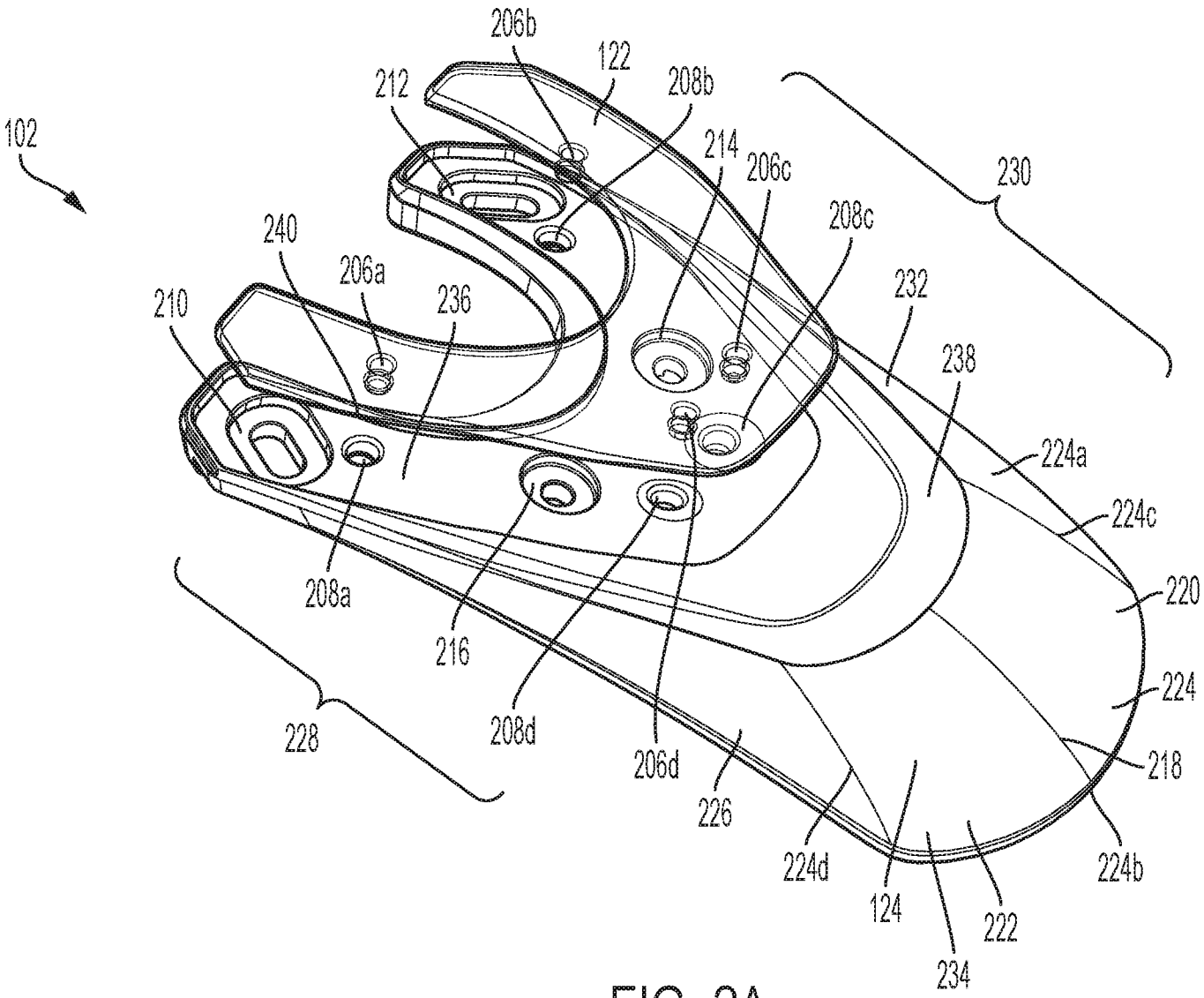
FIG. 2A illustrates an isometric view of an example ambidextrous face guard in an unassembled configuration.
Figure 2B:
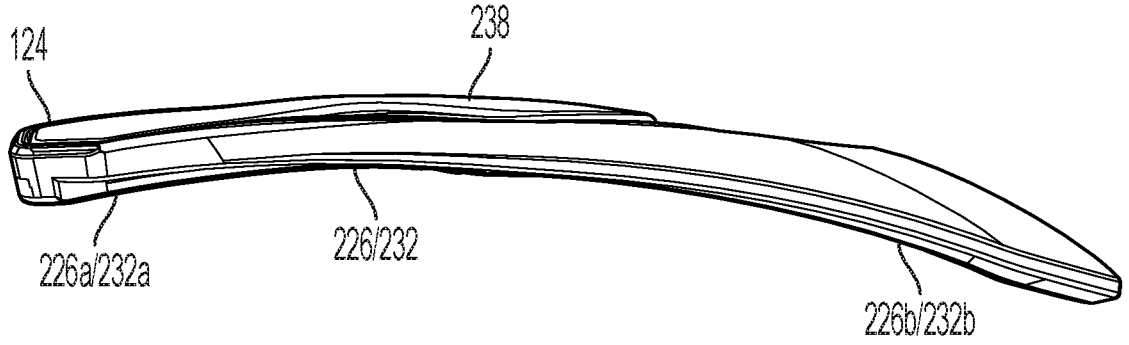
FIG. 2B illustrates a side view of an example ambidextrous face guard in an unassembled configuration.
Figure 2C:
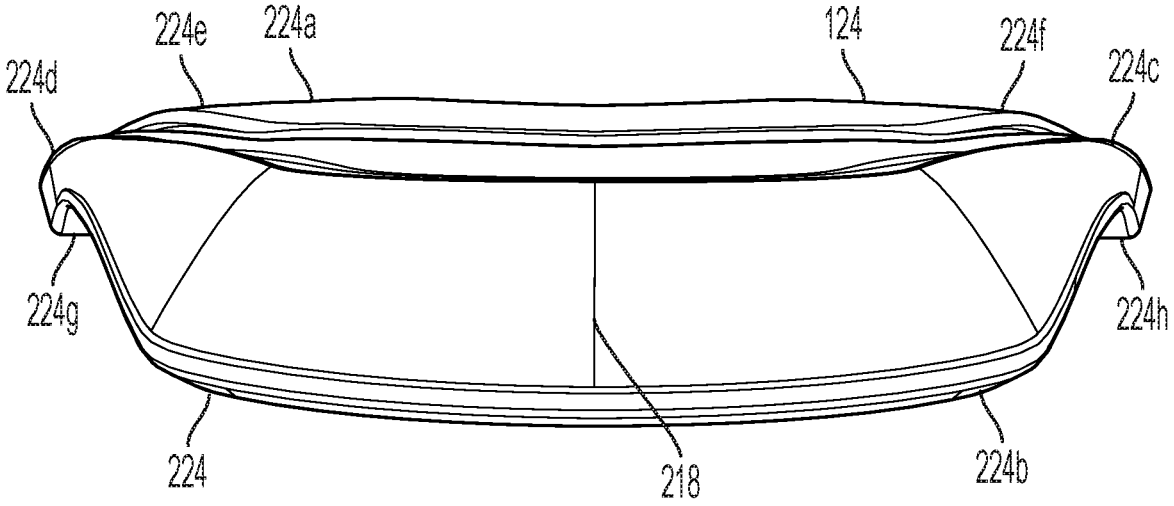
FIG. 2C illustrates a front view of an example ambidextrous face guard in an unassembled configuration.
Figure 3:
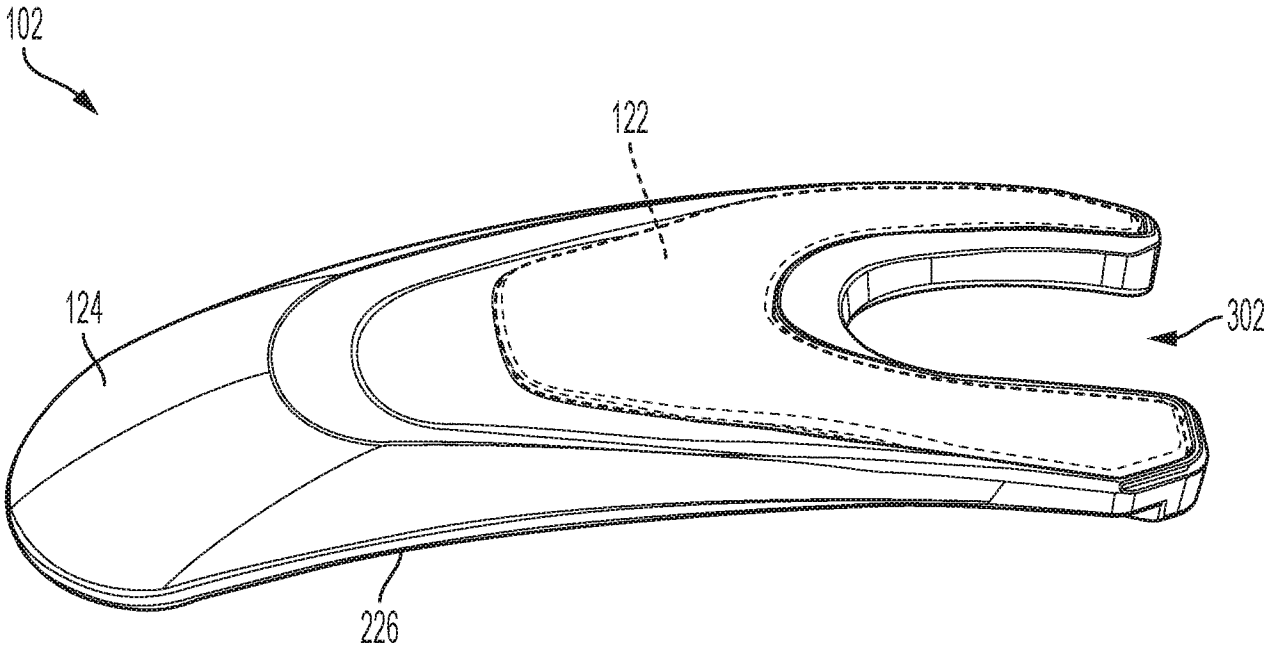
FIG. 3 illustrates an isometric view of an example ambidextrous face guard in an assembled configuration.
Figure 4:
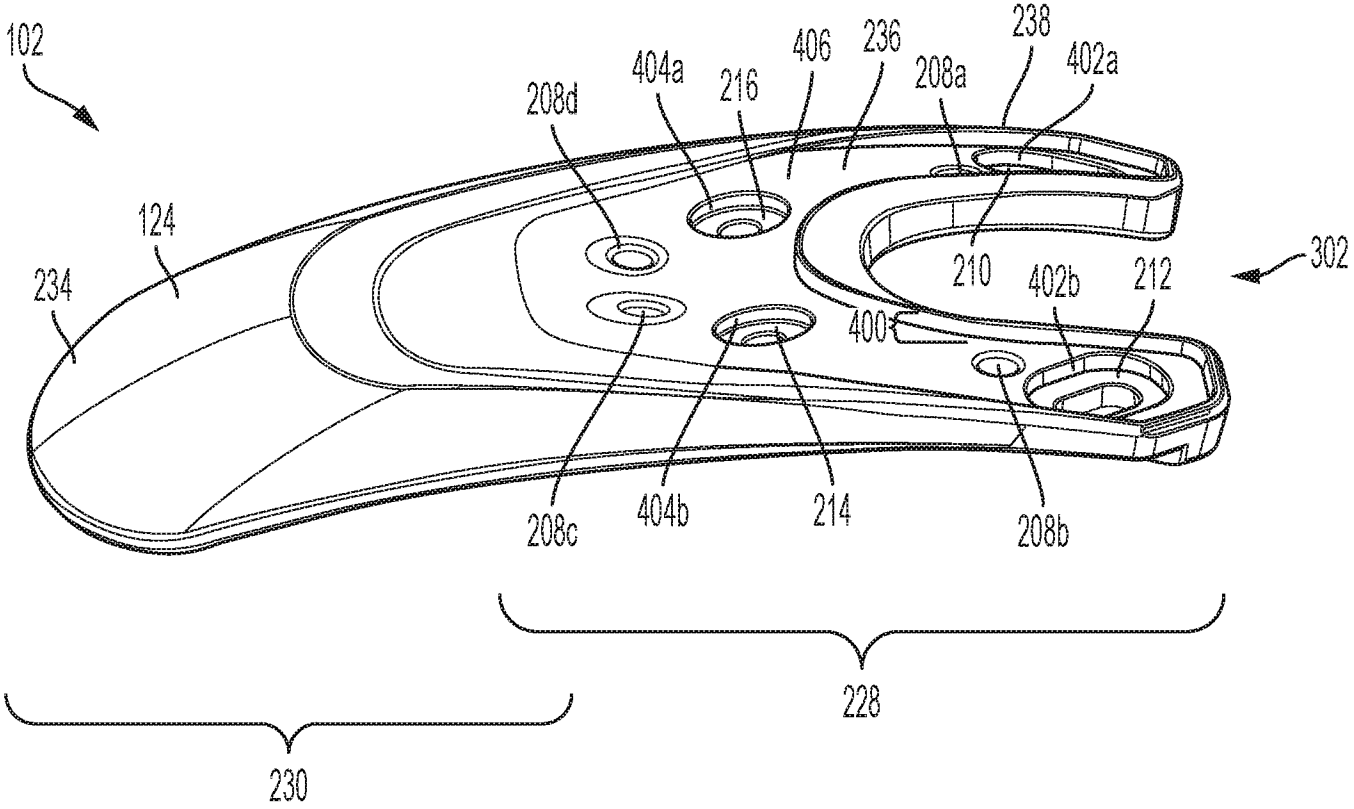
FIG. 4 illustrates an isometric view of an example guard plate of an ambidextrous face guard.
Figure 5:
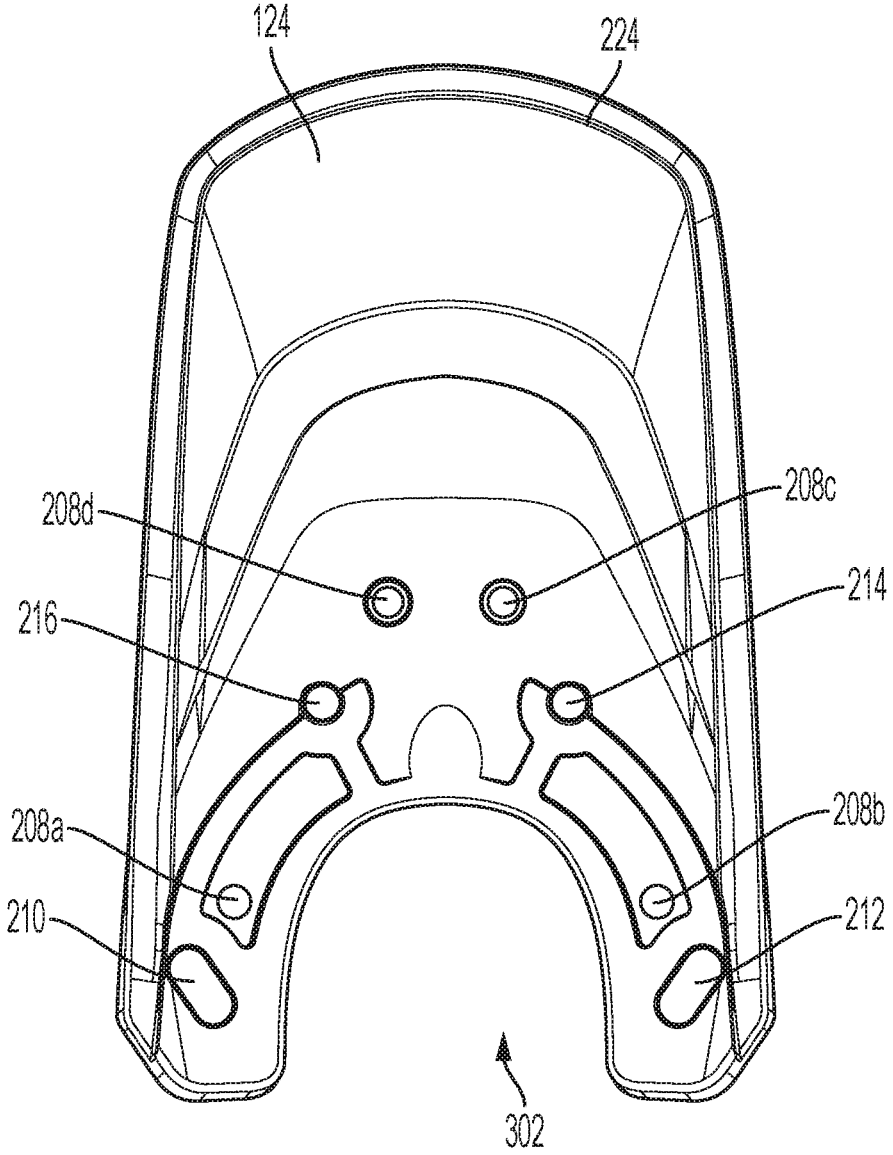
FIG. 5 illustrates a bottom view of an example guard plate of an ambidextrous face guard.

FIG. 2A illustrates an exploded view of the guard plate 124 and the cover plate 122 according to an embodiment. FIG. 2B illustrates a side view of the guard 102, and FIG. 2C illustrates a front view of the guard 102 according to an embodiment. FIG. 3 illustrates an isometric view of the guard 102 in an assembled configuration. FIG. 4 illustrates a side view of a guard plate 124 of the guard 102. FIG. 5 illustrates a bottom view of the guard plate 124 of the guard 102.

The guard 102 may be configured to protect one or more areas of a wearer's face, for example, the wearer's cheek and/or jaw. The guard 102 includes a guard plate 124 and, optionally, a cover plate 122. The guard 102 may have a cantilevered construction in which a proximal end portion of the guard 102 attaches over either a portion of the right ear cover 108*b* or a portion of the left ear cover 108*a*, and a distal end portion of the guard 102 projects outwards from the headgear 100 to protect the wearer from being directly contacted by an object, such as a baseball or softball. The proximal end portion of the guard 102 may have an attachment portion 228. The distal end portion of the guard 102 may include the protective portion 230.

The guard plate 124 of the guard 102 includes the attachment portion 228 and the protective portion 230. The attachment portion 228 and the protective portion 230 may be integrally formed with one another. Alternatively, the attachment portion 228 and the protection portion 230 may be attached to one another via any suitable means such as, for example, via one or more brackets, snaps, screws, or other types of fasteners. The attachment portion 228 is an elongated structure configured to attach to either a portion of the right ear cover 108*b* or a portion of the left ear cover 108*a*. In an embodiment, the attachment portion 228 may be rigid or semi-rigid about its attachment points. The protective portion 230 may be an elongated flexible structure or semi-flexible structure configured to absorb an impact from an object.

The attachment portion 228 may extend from a first end of a guard 102 towards a second end of a guard along a slope. The slope may be a three-dimensional curvature. The slope may be a curvature that extends across two or more planes. The protective portion 230 may extend from the attachment portion 228 toward the second end of the guard along the slope.

In one or more cases, a slope of the side edge 226 of the guard plate 124 may be the same or substantially the same as a slope of the other side edge 232 of the guard plate 124. A portion 226*a* of the side edge 226 and a portion 232*a* of the side edge 232 may each extend from the proximal end of the guard plate 124. The portions 226*a* and 232*a* may extend parallel with the outer surface of either the right ear cover 108*b* or the left ear cover 108*a*. A portion 226*b* of the side edge 226 and a portion 232*b* of the side edge 232 may each slope away from a top surface 238 of the attachment portion 228 the guard plate 124. That is, when the guard 102 is attached to the headgear 100, the portion 226*b* and the portion 232*b* may each slope towards the headgear 100. Each portion 226*b*, 232*b* may be a curved slope or a linear slope.

In one or more cases, the protective portion 230 of the guard plate 124 includes a trapezoidal portion 224 that is centered over a midline 218 of the guard plate 124. The trapezoidal portion 224 is positioned on a distal end of the guard plate 124. The outer surface 234 of the trapezoidal portion 224 may slope away from a top surface 238 of the guard plate 124 and inwards towards the headgear 100 when connected to the headgear 100. The top edge 224*a* of the outer surface 234 of the trapezoidal portion 224 may slope downwards from the midline 218 to an upper corner 224*f* of a side edge 224*c* of the trapezoidal portion 224, and from the midline 218 to an upper corner 224*e* of a side edge 224*d* of the trapezoidal portion 224. The bottom edge 224*b* of the outer surface 234 of the trapezoidal portion 224 may slope downwards from the midline 218 to a lower corner 224*g* of the side edge 224*c* and to a lower corner 224*h* of the side edge 224*d*. The slope of the top edge 224*a* may uniformly slope from the upper corner 224*f* to the upper corner 224*e*, and the slope of the bottom edge 224*b* may uniformly slope from the lower corner 224*g* to the lower corner 224*h*. That is, one half 220 of the trapezoidal portion 224, defined by the area extending from the midline 218 to the side edge 224*c* and the top edge 224*a* to the bottom edge 224*b*, is symmetrical to the other half 222 of the trapezoidal portion 224, defined by the area extending from the midline 218 to the side edge 224*d* and the top edge 224*a* to the bottom edge 224*b*. The slope may be a curved slope.

In one or more cases, the attachment portion 228 of the guard plate 124 includes at least two attachment points. An attachment point refers to a mechanism that facilitates connection of a guard plate 124 to a headgear 100. In certain embodiments, an attachment point may be a through hole. In other embodiments, an attachment point may be a clip, a bracket, a buckle and/or the like.

FIG. 2 illustrates attachment points that are through holes such as through hole 214, through hole 216, through hole 210 and through hole 212. Through holes 214, 216 may either be the same size or slightly larger than the diameter of the fastener and/or a respective connection point on a headgear 100. In one or more cases, the shape of the through holes 210, 212 may have the same or slightly larger width than the diameter of the fastener inserted therethrough and/or the respective connection point on a headgear 100. The length of the adjustable fastener holes may be larger than the connection point on the headgear 100 allowing the through hole to be easily positioned over the connection point. In one or more other cases, one or more of the through holes 210, 212, 214, 216 may be circular, oval, or any other suitable shape that is either the same size or slightly larger than the diameter of the fastener and/or the respective connection point on the headgear 100. As illustrated in FIG. 2, some attachment points may be located in proximity to one end of an attachment portion (e.g., through hole 210, 212), while other attachment points may be located in proximity to the other end of the attachment portion (e.g., through hole 214, 216).

The through holes 210, 212, 214, 216 may be arranged to align with and fastened to at least two connection points on a headgear 100. For example, for the cases in which the guard 102 is attached to the left side of the headgear 100, the through hole 210 may align with the first connection point 114*a*, through hole 216 may align with the second connection point 114*b*, and through hole 212 may align with the third connection point 114*c*. In another example, for the cases in which the guard 102 is attached to the right side of the headgear 100, through hole 212 may align with the first connection point 112*a*, through hole 214 may align with the second connection point 112*b*, and through hole 210 may align with the third connection point 112*c*.

Having aligned the through holes with the respective connection points, a fastener may be inserted through one or more through holes and respective connection point. A fastener may be a mechanism that at least partially secures a guard 102 to a headgear 100. Example fasteners include without limitation, bolts, screws, rods, and/or the like.

Each fastener is then tightened, thereby fastening the guard 102 to the respective ear cover. For the cases in which the connection point is a through hole and the fastener is unthreaded, a distal end of the fastener may extend beyond the inner surface of the respective ear cover, and a nut or other similar fastener may be tightened on the distal end of the fastener, thereby fastening the guard 102 to the headgear 100. For the cases in which the connection point includes a threaded portion and the fastener includes a threaded end portion, the threaded end portion of the fastener may be fastened to the threaded portion of the connection point, thereby fastening the guard 102 to the headgear 100.

Figure 9A:
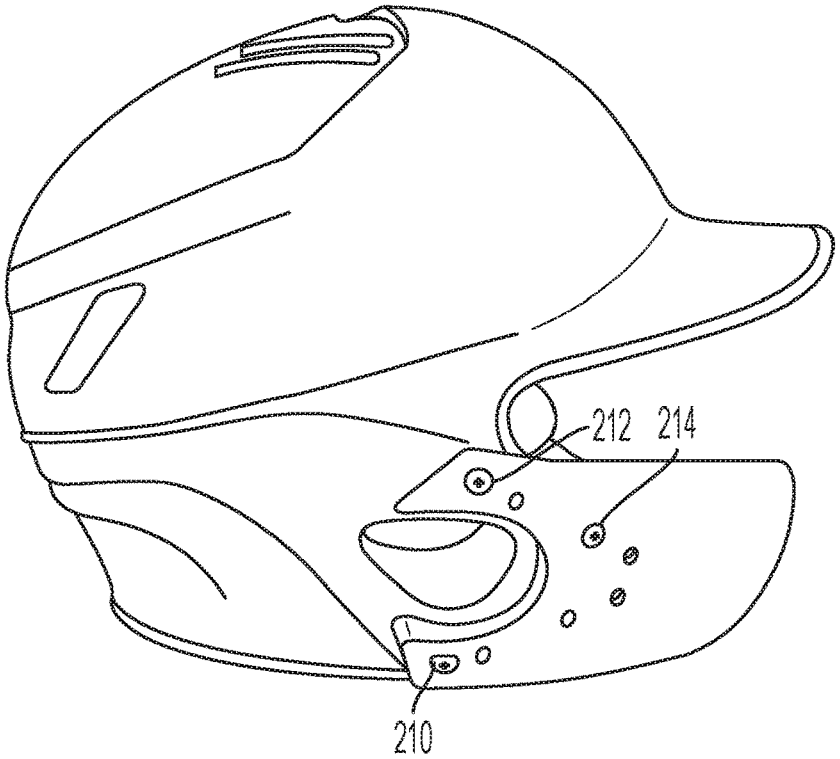
FIGS. 9A and 9B illustrate example through hole placement of an example guard connected to an example headgear according to various embodiments.
Figure 9B:
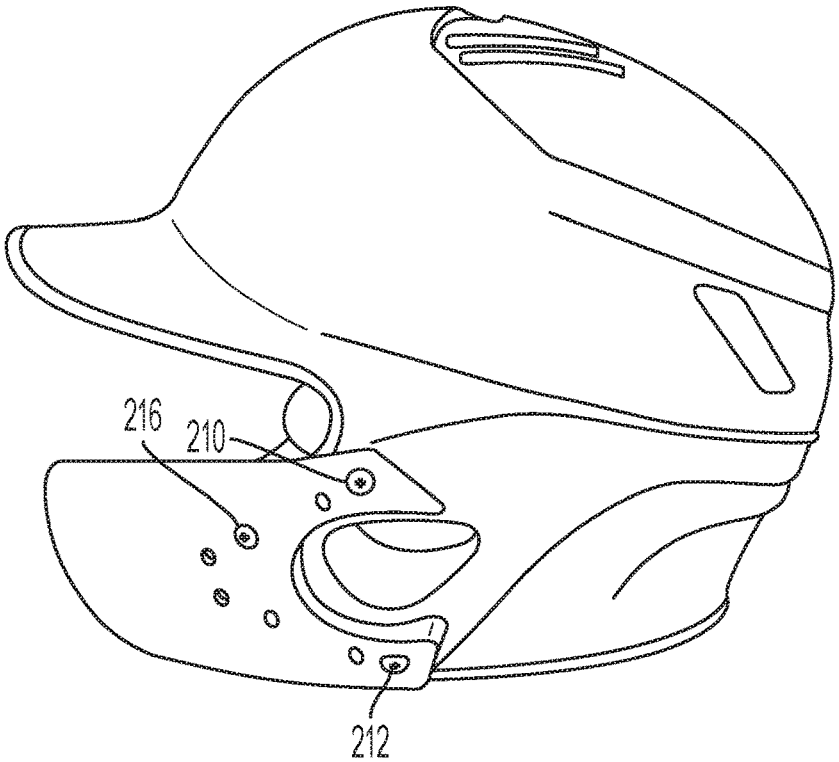

In one or more cases, at least two of the through holes may be fastened to the headgear 100. In one example, for the cases in which the guard 102 is attached to a left side of the headgear 100, the through hole 210 and the through hole 212 may be fastened to the headgear 100. In another example, for the cases in which the guard 102 is attached to a right side of the headgear 100, the through hole 210 and the through hole 212 may be fastened to the headgear 100. In one or more cases, at least three of the through holes may be fastened to the headgear 100. In one example, for the cases in which the guard 102 is attached to a left side of the headgear 100, the through hole 210, through hole 212, and through hole 216 may be fastened to the headgear 100. In another example, for the cases in which the guard 102 is attached to a right side of the headgear 100, the through hole 210, the through hole 212, and the through hole 214 may be fastened to the headgear 100. FIGS. 9A and 9B illustrate example through hole placement of an example guard connected to an example headgear according to various embodiments. FIG. 9A illustrates an example guard attached to a right side of an example headgear via through holes 210, 212, 214, while FIG. 9B illustrates an example guard attached to a left side of an example headgear via through holes 210, 212, 216.

Padding, foam, and/or a soft cushion-like material may be positioned on an inner surface of an ear cover of the headgear 100. The padding, foam, and/or soft cushion-like material may be used to prevent the wearer's face from contacting one or more fasteners that are used to fasten the guard 102 to the headgear 100. The padding, foam, and/or soft cushion-like material may be positioned to extend around a respective ear hole, such that the ear hole remains unobstructed or at least partially unobstructed. The padding, foam, and/or soft cushion-like material may be removably fastened to the ear cover. For example, the padding, foam, and/or soft cushion-like material may be removably fastened to the ear cover via hook and loop closures, adhesive, or other attachment materials known to one of ordinary skill in the art. When attaching the guard 102 to the headgear 100, a user may fasten the guard 102 to the headgear 100 as discussed above, and subsequently fasten the padding, foam, and/or a soft cushion-like material to the inner surface of the ear cover.

In one or cases, the guard plate 124 includes a recessed portion 236, which encompasses at least one of the through holes. As shown in FIG. 4, the top surface 406 of the recessed portion 236 may be positioned below the top surface 238 of the guard plate 124. The recessed portion 236 may be configured in a shape to receive the cover plate 122. The recessed depth 400, extending from the top surface 238 of the guard plate 124 to the top surface 406 of the recessed portion 236, may be deep enough to accommodate the thickness of the cover plate 122, such that the outer surface of the cover plate 122 sits flush or substantially flush with the top surface 238 of the guard plate 124 when the cover plate 122 is positioned within the guard plate 124.

Through holes 210, 212, 214, 216 may be recessed below the top surface 406 of the recessed portion 236. For example, through hole 216 may include a recessed portion 404*a*, through hole 214 may include a recessed portion 404*b*, the through hole 210 may include a recessed portion 402*a*, and the through hole 212 may include a recessed portion 402*b*. The recessed portions of the through holes 210, 212, 214, 216 may be recessed into the guard plate 124 deep enough to accommodate a head of a fastener and allow the top surface of the head of the fastener to sit at or below the top surface 406 of the recessed portion 236. By recessing the heads of the one or more fasteners, the bottom surface 240 of the cover plate 122 may reside on the top surface 406 of the recessed portion 236 and the cover plate 122 may sit flush or substantially flush with the top surface 238 of the guard plate 124. The diameter of the recessed portions 402*a*, 402*b*, 404*a*, and 404*b* may be larger than a head of a fastener inserted through the respective through hole.

In one or more cases, the cover plate 122 may include one or more posts, such as posts 206*a*, 206*b*, 206*c*, and 206*d*. As illustrated by FIG. 2A, a post may be a rigid structure protruding outwards from the bottom surface 240 of the cover plate 122. The rigid structure of the posts may be formed in a variety of shapes, such as a polyhedronal shape, a cylindrical shape, a prism shape, and/or the like. The recessed portion 236 of the guard plate 124 may include one or more post receivers, such as post receiver 208*a*, 208*b*, 208*c*, and 208*d*, each configured in a shape corresponding to the shape of the respective post, in order to receive the respective post. The one or more post receivers may be positioned within the recessed portion 236 to correspond to the position of the one or more posts on the cover plate 122. Alternatively, in one or more other cases, the recessed portion 236 of the guard plate 124 includes one or more post and the cover plate 122 includes one or more post receivers.

The attachment portion 228 of the guard plate 124 may be formed in a shape that does not obstruct or only partially obstructs an ear hole of the headgear 100 when the guard 102 is attached to a headgear 100. For example, the attachment portion 228 may be formed in a U-shape, in which the shape of the attachment portion 228 is configured to extend around the ear hole of the headgear 100. In one or more cases, one or more of the through holes 210, 212, 214, 216 may be disposed around the portion of the attachment portion 228 that is configured to extend around the ear hole of the headgear 100. For example, the one or more of the through holes 210, 212, 214, 216 may be disposed in a U-shape or substantially U-shape pattern. In one or more cases, the post insert receivers may be disposed around the portion of the attachment portion 228 that is configured to extend around the ear hole of the headgear 100.

Although an attachment portion 228 having a U-shape is discussed in this disclosure, it is understood that attachment portions having alternate shapes may be used within the scope of this disclosure. For example, an attachment portion 228 may have a square or rectangular shape in various embodiments.

Figure 6:
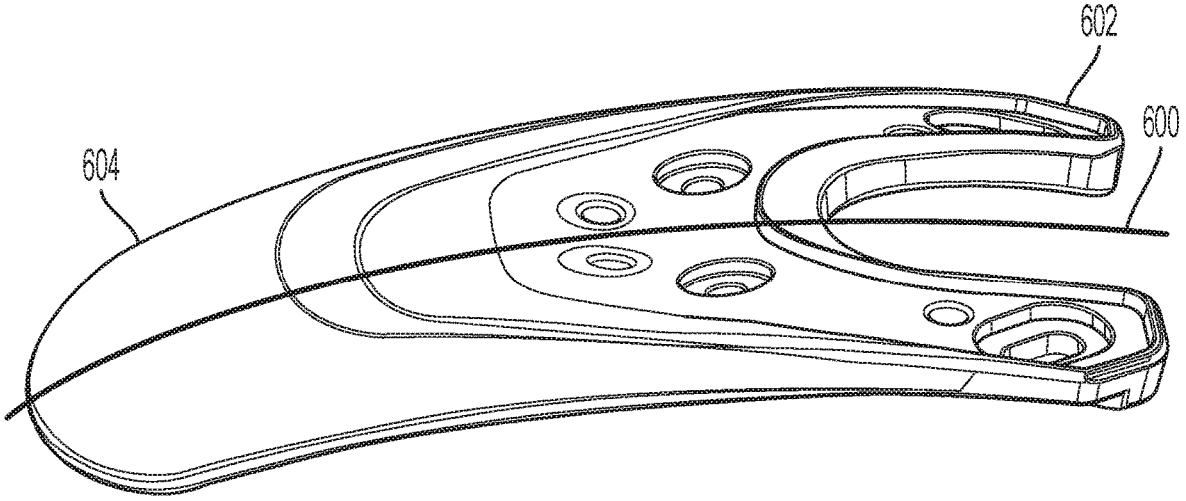
FIG. 6 illustrates an example line of symmetry of an ambidextrous face guard.
Figure 7:
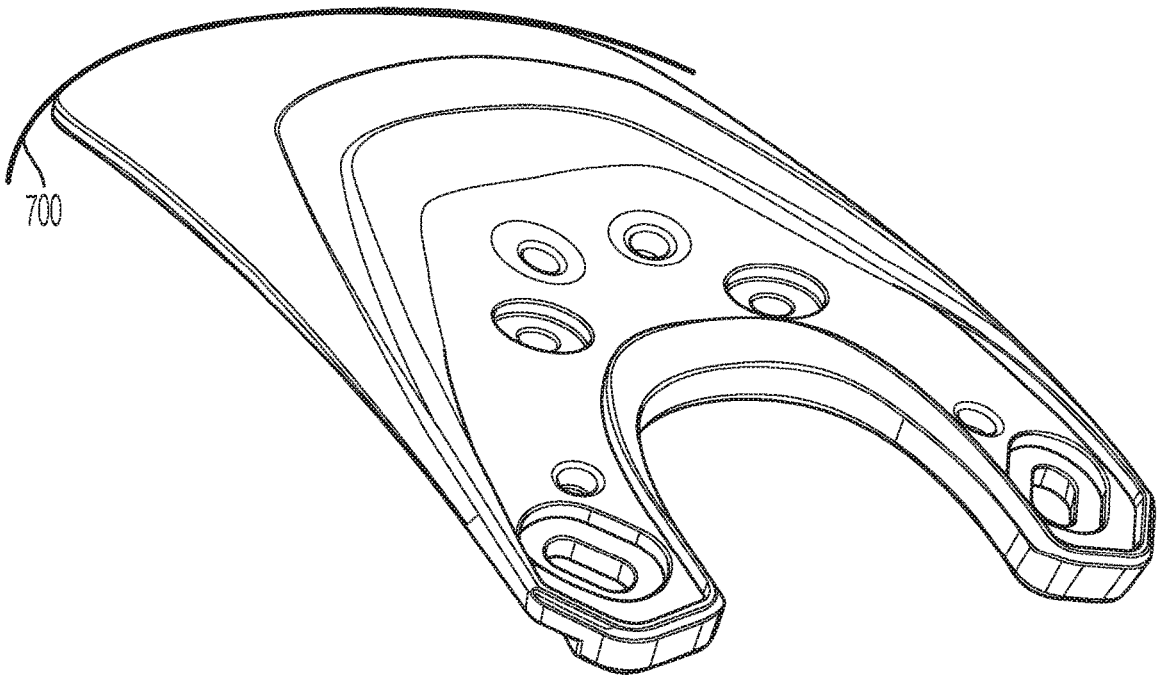
FIGS. 7 and 8 illustrate an example ambidextrous face guard.

As discussed throughout this disclosure, at least a portion of the guard 102 has a symmetrical shape relative to a line of symmetry 600 as illustrated in FIG. 6. As illustrated in FIG. 6, the line of symmetry 600 extends from a first end 602 of the guard to a second end 604 of the guard, such that the line defines two symmetric halves of the guard along its length. This symmetrical design allows for both adequate face coverage/protection and visibility during use, regardless of whether the guard is attached to the left side or the right side of a headgear. As illustrated in FIG. 6, the line of symmetry 600 may be a curve that extends across two or more planes. As such, the fit of the guard may be the same whether the guard is attached to the left side or the right side of a headgear. In addition, the line of symmetry 600 may extend semi-parallel to a wearer's face line when attached to headgear worn by the wearer. This curved line of symmetry 600 may create a convex angle 700 on the guard 102 as illustrated in FIG. 7. As shown in FIG. 7, an end of the guard 102 is curved along a convex angle 700.

Figure 8:
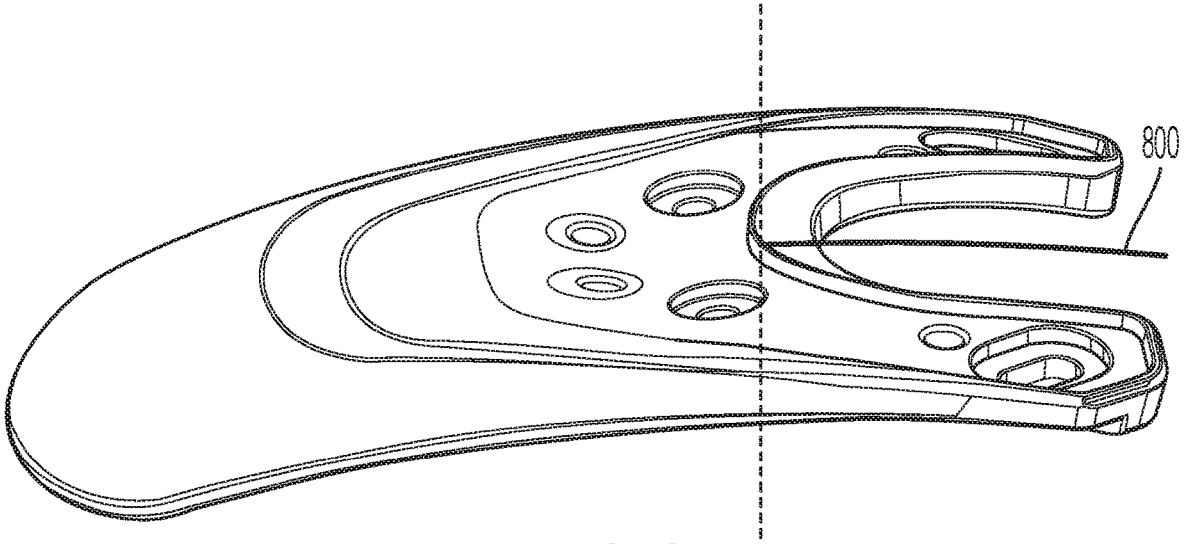

In various embodiments, the line of symmetry 600 may extend along an entire length of a guard 102 as illustrated in FIG. 6. In another embodiment, a line of symmetry may extend only along a portion of the length of a guard 102 as illustrated in FIG. 8. As illustrated in FIG. 8, the line of symmetry 800 may extend from a first end of a guard toward a second end of the guard. However, the line of symmetry 800 may not extend the entire length of the guard. As such, the line of symmetry 800 may define two symmetric portions of the guard that extend only partially along the length of the guard. For example, a guard may have two symmetric portions in proximity to the attachment portion of the guard, as illustrated by FIG. 8. However, a portion of the guard near the distal end of the guard may or may not have symmetry.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. An ambidextrous face guard comprising:

an attachment portion comprising at least two attachment points, wherein the attachment portion extends from a first end of the ambidextrous face guard toward a second end of the ambidextrous face guard along a slope; and a protective portion extending from the attachment portion toward the second end of the ambidextrous face guard along the slope, wherein the protective portion is a semi-flexible or flexible structure, wherein the protective portion comprises:

a top surface, a first side portion that extends from the attachment portion toward the second end of the ambidextrous face guard along a first edge of the top surface, wherein the first side portion slopes downward from the top surface, a second side portion that extends from the attachment portion toward the second end of the ambidextrous face guard along a second edge of the top surface, wherein the second side portion slopes downward from the top surface, and a distal portion located at the second end of the ambidextrous face guard, wherein a proximal edge of the distal portion is curved and is formed by at least a portion of the top surface, a first side edge of the distal portion is formed by at least a portion of the first side portion, a second side edge of the distal portion is formed by at least a portion of the second side portion, and a distal edge of the distal portion is curved and is formed by at least a portion of a distal edge of the protective portion, wherein the distal portion slopes downward from the top surface, the first side edge of the distal portion extending from the proximal edge of the distal portion to the distal edge of the distal portion, and the second side edge of the distal portion extending from the proximal edge of the distal portion to the distal edge of the distal portion;

wherein a line of symmetry extends along at least the attachment portion from the first end of the ambidextrous face guard toward the second end of the ambidextrous face guard such that the line of symmetry defines two symmetric portions of the ambidextrous face guard that each extend along at least a portion of a length of the ambidextrous face guard, wherein the ambidextrous face guard is configured to:

attach to an outer surface of a right side and an outer surface of a left side of a headgear via one or more of the attachment points, and extend outwardly from the headgear such that at least a portion of protective portion covers at least a portion of a face of a wearer when the ambidextrous face guard is attached to the headgear and the headgear is worn by the wearer.

2. The ambidextrous face guard of claim 1, wherein the attachment portion is a U-shaped structure in which the at least two attachment points are arranged on the U-shaped structure.

3. The ambidextrous face guard of claim 1, further comprising a cover plate, wherein the attachment portion comprises a recessed area, and the cover plate is configured to be received within the recessed area.

4. The ambidextrous face guard of claim 3, wherein:

the recessed area comprises one or more post receivers positioned within the attachment portion, the cover plate comprises one or more posts protruding from a bottom surface of the cover plate, and wherein a post of the one or more posts is configured to fit within a respective post receiver of the one or more post receivers.

5. The ambidextrous face guard of claim 1, the second end of the ambidextrous face guard is curved along a convex angle.

6. The ambidextrous face guard of claim 1, wherein a first symmetrical half of the protective portion slopes downwards from a middle portion of the protective portion to a first side edge of the protective portion and from a top edge of the protective portion to a bottom edge of the protective portion, and a second symmetrical half of the protective portion slopes downwards from the middle portion to a second side edge of the protective portion and from the top edge to the bottom edge.

7. The ambidextrous face guard of claim 1, wherein the ambidextrous face guard is configured to cover at least a portion of a face of a user, when attached to the headgear and the headgear is worn by the user.

8. The ambidextrous face guard of claim 1, wherein the protective portion is configured to absorb an impact from an object.

9. The ambidextrous face guard of claim 1, wherein the line of symmetry is a curved line of symmetry, and the slope is curved.

10. The ambidextrous face guard of claim 1, wherein:

one or more of the attachment points comprise one or more through holes, each through hole is configured to receive a fastener, and each fastener is configured to fasten the guard to one or more connection points of the headgear.

11. The ambidextrous face guard of claim 1 comprising:

a first attachment point;

a second attachment point;

a third attachment point; and a fourth attachment point;

wherein:

the first attachment point and the second attachment point are located in proximity to a first end of the attachment portion, the third attachment point and the fourth attachment point are located in proximity to a second end of the attachment portion, the first attachment point, the second attachment point and the third attachment point are configured to align with connection points on the left side the headgear, the first attachment point, the second attachment point and the fourth attachment point are configured to align with connection points on the right side of the headgear.

* * * * *